US008205953B2

(12) United States Patent
Azuma et al.

(10) Patent No.: US 8,205,953 B2
(45) Date of Patent: Jun. 26, 2012

(54) INKJET PRINTING APPARATUS, INKJET PRINTING SYSTEM, AND INKJET PRINTING METHOD

(75) Inventors: Satoshi Azuma, Kawasaki (JP); Noribumi Koitabashi, Yokohama (JP); Shigeyasu Nagoshi, Yokohama (JP); Koichiro Nakazawa, Machida (JP)

(73) Assignee: Canon Kabushiki Kaisha, Tokyo (JP)

( * ) Notice: Subject to any disclaimer, the term of this patent is extended or adjusted under 35 U.S.C. 154(b) by 324 days.

(21) Appl. No.: 12/636,854

(22) Filed: Dec. 14, 2009

(65) Prior Publication Data

US 2010/0156980 A1 Jun. 24, 2010

(30) Foreign Application Priority Data

Dec. 19, 2008 (JP) ..... 2008-324155

(51) Int. Cl.
*B41J 29/38* (2006.01)

(52) U.S. Cl. ..... 347/14; 347/19

(58) Field of Classification Search ..... 347/14, 347/19

See application file for complete search history.

(56) References Cited

U.S. PATENT DOCUMENTS

| | | | | |
|---|---|---|---|---|
| 5,696,542 | A | 12/1997 | Matsubara et al. | |
| 5,907,337 | A | 5/1999 | Tajika et al. | |
| 6,068,365 | A | 5/2000 | Nagoshi et al. | |
| 6,164,745 | A | 12/2000 | Nagoshi et al. | |
| 6,390,583 | B1 | 5/2002 | Kato et al. | |
| 6,540,326 | B2 | 4/2003 | Matsubara et al. | |
| 7,216,948 | B2 | 5/2007 | Matsuzaki et al. | |
| 7,441,854 | B2 | 10/2008 | Jahana et al. | |
| 7,591,521 | B2 | 9/2009 | Aruga | |
| 7,695,087 | B2 | 4/2010 | Tsuboi | |
| 2005/0062784 | A1 * | 3/2005 | Matsuzaki et al. | 347/19 |
| 2006/0279606 | A1 * | 12/2006 | Jahana et al. | 347/47 |
| 2007/0120883 | A1 | 5/2007 | Tsuboi | |
| 2007/0242098 | A1 * | 10/2007 | Sudo et al. | 347/40 |
| 2008/0252673 | A1 | 10/2008 | Wada et al. | |
| 2009/0015614 | A1 | 1/2009 | Jahana et al. | |

FOREIGN PATENT DOCUMENTS

| | | | |
|---|---|---|---|
| JP | 5-57965 | A | 3/1993 |
| JP | 10-35021 | | 2/1998 |
| JP | 2000-307865 | A | 11/2000 |
| JP | 2004-237725 | A | 8/2004 |
| JP | 2005-53167 | | 3/2005 |
| JP | 2006-205490 | A | 8/2006 |
| JP | 2006-341518 | | 12/2006 |
| JP | 2006-347164 | A | 12/2006 |
| JP | 2007-30503 | A | 2/2007 |
| JP | 2007-152582 | A | 6/2007 |
| JP | 2007-268946 | A | 10/2007 |
| JP | 2007-301952 | | 11/2007 |
| JP | 2008-221832 | A | 9/2008 |

OTHER PUBLICATIONS

Japanese Office Action issued in corresponding application No. 2008-324155 dated Jul. 8, 2011—2 pages.

* cited by examiner

*Primary Examiner* — Laura Martin

(74) *Attorney, Agent, or Firm* — Fitzpatrick, Cella, Harper & Scinto

(57) ABSTRACT

An inkjet printing apparatus, an inkjet printing system and an inkjet printing method are provided in order to correct a print density at a joint (overlapped portion) of nozzle arrays of a print head. The print density at the joint (overlapped portion) of the nozzle arrays is corrected based on a positional deviation between two adjacent nozzle arrays of the print head.

7 Claims, 16 Drawing Sheets

| DEVIATION | DENSITY CORRECTION VALUE |
|---|---|
| -1.5 PIXELS | 95.5 % |
| -1.0 PIXEL | 97.0 % |
| -0.5 PIXEL | 98.5 % |
| -0.25 PIXEL | 99.2 % |
| 0.0 PIXEL | 100.0 % |
| 0.25 PIXEL | 100.8 % |
| 0.5 PIXEL | 101.6 % |
| 1.0 PIXEL | 103.2 % |
| 1.5 PIXELS | 104.9 % |

FIG.13

INKJET PRINTING APPARATUS, INKJET PRINTING SYSTEM, AND INKJET PRINTING METHOD

BACKGROUND OF THE INVENTION

1. Field of the Invention

The present invention relates to an inkjet printing apparatus that performs printing by ejecting ink onto a printing medium, such as a printing sheet, and an inkjet printing system and an inkjet printing method therefor.

2. Description of the Related Art

With respect to the production of elongated print heads for use in full line-type inkjet printing apparatuses, many problems exist that affect both the technique employed and the costs involved in the high density arrangement, in a line, of multiple nozzles on a single substrate. Therefore, a chip joining type print head (hereinafter also referred to as a "multi-segment print head") is employed in line-type inkjet printing apparatuses. The multi-segment print head is an elongated print head provided by arranging, in a zigzag manner, a plurality of comparatively short heads (hereinafter also referred to as "chips"), in each of which multiple nozzles are closely arranged.

For arranging multiple chips, accurate positioning is required. If precise positioning fails, and chips are offset from adjacent chips, a white line or a black line (hereinafter also referred to as a joint defective line) may appear at the image portion corresponding to the joint between the adjacent chips, deteriorating the printing quality. Further, if the print head is not accurately mounted at the head position of the ink-jet printing apparatus, this line-like printing defect will also appear.

A method for suppressing such printing defects is proposed in Japanese Patent Laid-Open No. H05-57965 (1993). According to this method, multiple chips are arranged so they overlap the ends of adjacent chips, and in the overlapping portion of one chip, the print density of dot (printing duty) is gradually reduced, while in the overlapping portion of the other chip, to complement the print density reduction, the print density is gradually increased.

However, as in the case of Japanese Patent Laid-Open No. H05-57965 (1993), wherein the print densities in overlapped portions of adjacent chips are complementarily increased and decreased, when a misalignment of relative chip positions occurs, the complementary print density relationship is not maintained for the overlapping portions of the adjacent chips, and density fluctuation occur. Methods for resolving the offset of chip positions, such as by shifting image data, or shifting the area covered by a nozzle so as to shift the print positions of chips, are well known. However, these methods for adjusting print positions can not be carried out without either the shifting of image data for each pixel, or the shifting of nozzle coverage area for every nozzle pitch. Because of this, when chips are misaligned, for example, a distance equivalent to half the size of a pixel, the density fluctuation caused by this offset cannot be reduced by these methods.

SUMMARY OF THE INVENTION

The present invention provides an inkjet printing apparatus that can appropriately correct a print density at a joint portion (an overlapped portion) of nozzle arrays, an inkjet printing system employing the inkjet printing apparatus, and an inkjet printing method therefor.

In the first aspect of the present invention, there is provided an inkjet printing apparatus comprising: a printing unit that employs a print head in which a plurality of nozzle arrays, each formed of multiple nozzles for ejecting ink, are positioned by being displaced in a direction in which the nozzles are arranged so that a nozzle array has an overlapped portion with an adjacent nozzle array, and the printing unit prints on an area of a printing medium corresponding to the overlapped portion by using the two adjacent nozzle arrays; and a correction unit that corrects a print density of the area of the printing medium corresponding to the overlapped portion based on a positional deviation, in the direction in which the nozzles are arranged, of landing positions of ink ejected from the two adjacent nozzle arrays.

In the second aspect of the present invention, there is provided a printing system comprising: a printing unit that employs a print head in which a plurality of nozzle arrays, each formed of multiple nozzles for ejecting ink, are positioned by being displaced in a direction in which the nozzles are arranged so that a nozzle array has an overlapped portion with an adjacent nozzle array, and the printing unit prints on an area of a printing medium corresponding to the overlapped portion by using the two adjacent nozzle arrays; and a correction unit that corrects a print density of the area of the printing medium corresponding to the overlapped portion based on a positional deviation, in the direction in which the nozzles are arranged, of landing positions of ink ejected from the two adjacent nozzle arrays.

In the third aspect of the present invention, there is provided a printing method comprising the steps of: preparing a print head in which a plurality of nozzle arrays, each formed of multiple nozzles for ejecting ink, are positioned by being displaced in a direction in which the nozzles are arranged so that a nozzle array has an overlapped portion with an adjacent nozzle array; printing on an area of a printing medium corresponding to the overlapped portion by using the two adjacent nozzle arrays; and correcting a print density of the area of the printing medium corresponding to the overlapped portion based on a positional deviation, in the direction in which the nozzles are arranged, of landing positions of ink ejected from the two adjacent nozzle arrays.

According to the present invention, the print density at a joint portion (an overlapped portion) of adjacent nozzle arrays is corrected based on a positional deviation, in the nozzle array direction, at the joint (the overlapped portion) of the adjacent nozzle arrays, so that a high quality image can be printed.

Further features of the present invention will become apparent from the following description of exemplary embodiments (with reference to the attached drawings).

BRIEF DESCRIPTION OF THE DRAWINGS

FIG. 13 is a diagram for explaining a density correction table for the first embodiment of the present invention;

DESCRIPTION OF THE EMBODIMENTS

The embodiments of the present invention will now be described in detail while referring to the accompanying drawings.

First Embodiment

Figure 1:
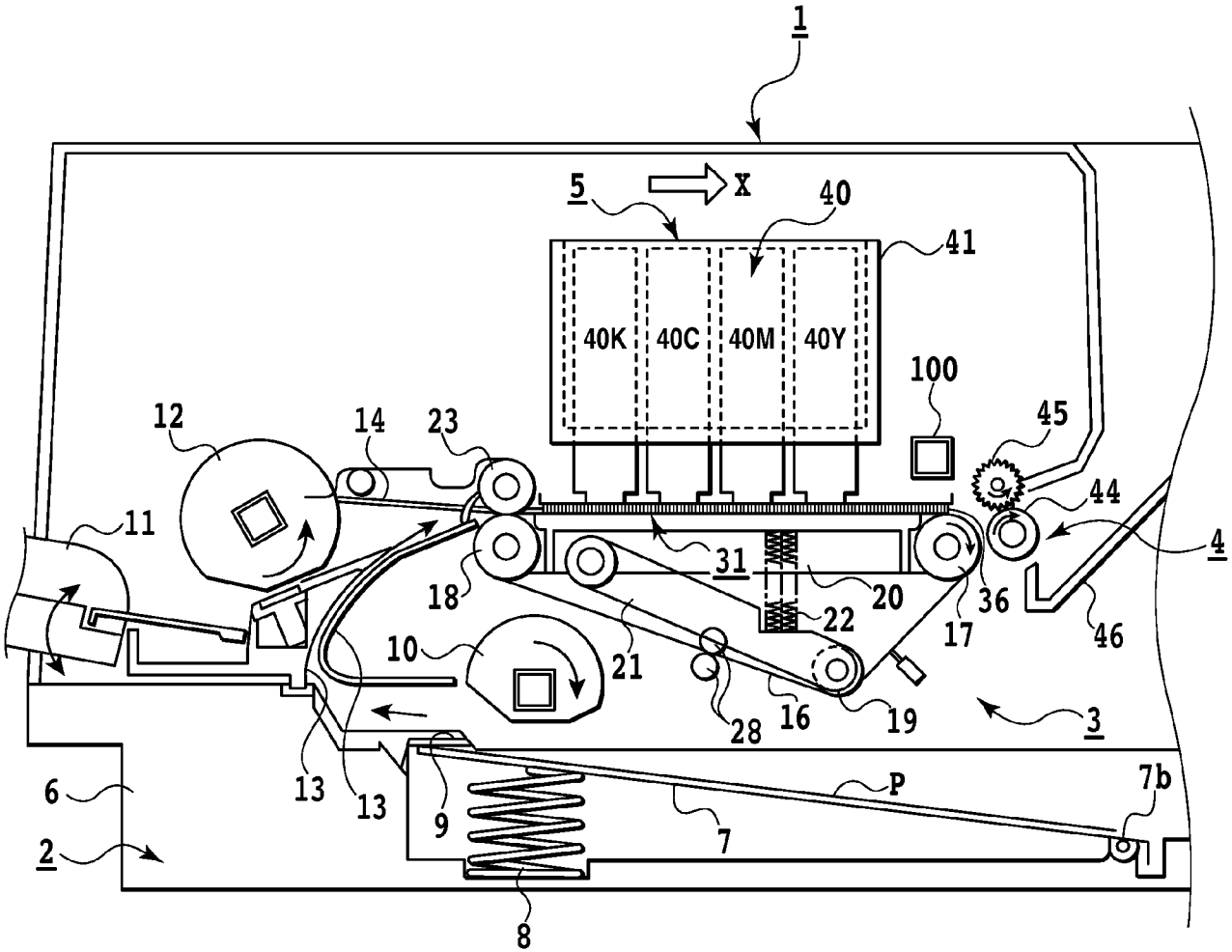
FIG. 1 is a schematic cross-sectional view of the configuration of an inkjet printing apparatus for which the present invention is applied.

FIG. 1 is a cross-sectional view explaining an example configuration of an inkjet printing apparatus to which the present invention can be applied.

The inkjet printing apparatus 1 of this embodiment is equipped with an automatic document feeder, and includes a feeding unit 2, a printing unit 5 and a discharge unit 4. In the feeding unit 2, a pressure plate 7, on which printing sheets P used as printing media are stacked, and feeding rollers 10 for feeding the printing sheets P are provided in a base 6. Pressure plate 7 can be pivoted around the rotary shaft 7*b* fixed to the base 6, and is biased toward the direction of the feeding rollers 10 due to the bearing spring 8. Further, a separator 9 for separating the printing sheets P is provided in the base 6. When the rotation of the feeding rollers 10 begins, the printing sheets P on the pressure plate 7 are picked up and separated into individual sheets by the separator 9, and each printing sheet P is fed to a conveying unit 3. Printing sheets P can also be stacked on a manual feed tray 11 located on the side of the inkjet printing apparatus 1. Then, when the rotation of manual feed rollers 12 begins in accordance with a print command signal received from, for example, a computer, the printing sheet P on the manual feed tray P is fed to the conveying unit 3 along a lower guide 13 and an upper guide 14.

The conveying unit 3 includes a conveying belt 16 along which the printing sheet P is to be conveyed while held by suction. The conveying belt 16 is extended between a drive roller 17 located downstream, a drive roller 18 located upstream and a pressure roller 19. The pressure roller 19 is rotatably fitted to one end of an arm 21, the other end of which is pivotally attached to a platen 20. With this structure, tension is applied to the conveying belt 16 by the biasing force of springs 22. A pinch roller 23 and the conveying belt 16 sandwich the printing sheet P and convey it to the printing unit 5.

In the printing unit 5, a full line type inkjet print head 40 is detachably mounted, and a plurality of nozzles are arranged across the overall width of the printing sheet P in a direction that intersects (and in this case, is perpendicular to) a direction X in which the printing sheet P is conveyed. The print head 40 includes black ink head 40K, cyan ink head 40C, magenta ink head 40M and yellow ink head 40Y. The color ink heads 40K, 40C, 40M and 40Y are stored in a head holder 41 and are positioned in the named order at predetermined intervals from upstream to downstream in the direction in which the printing sheet P is conveyed. Further, the inkjet printing apparatus 1 includes a scanning unit (detection means) for detecting an image on the printing sheet P, as described later. The discharge unit 4 includes discharge rollers 99 and spur rollers 45. The printing sheet P on which an image is formed by the printing unit 5 is conveyed by the discharge roller 44 and the spur 45, and is delivered to a paper discharge tray 46.

Figure 2A:
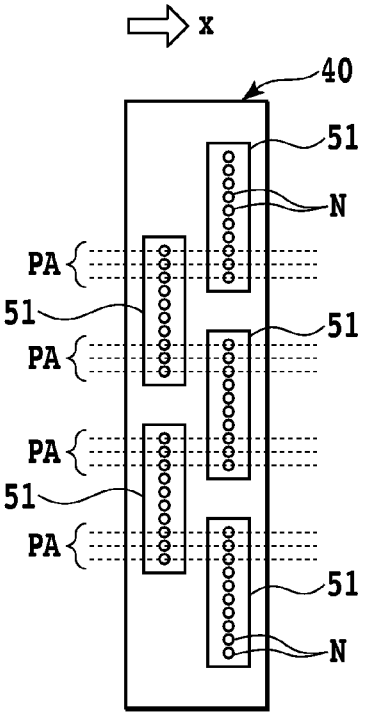
FIG. 2A is a schematic diagram illustrating the arrangement of an example inkjet line head that can be mounted on the inkjet printing apparatus in FIG. 1.

FIG. 2A is a schematic diagram showing the structure of the print head 40 employed in the inkjet printing apparatus 1. The print head 40 of this embodiment is formed by arranging in a zigzag manner multiple chips 51, for each of which nozzles N are provided to serve as printing elements. The nozzles N include ink ejection ports, ink flow paths and ink ejection energy devices, which can be, for example, electrothermal conversion elements (heaters) or piezoelectric elements. When electrothermal conversion elements are employed, ink is heated by the electrothermal conversion elements, and energy generated by bubbling ink is employed to eject ink through the ink ejection ports.

The nozzles N of the individual chips 51 are located at predetermined nozzle pitches, and the adjacent chips 51 are overlapped at joints PA such that a predetermined number of nozzles overlap. In the following explanation, the joints PA of the chips 51 are called chip joints, or simply joints.

For the sake of convenience, the example in FIG. 2A shows five chips 51 and ten nozzles for each chip 51, and three nozzles for the overlap at each joint PA. It should be noted, however, that the numerical values are not limited to those employed here.

Figure 2B:
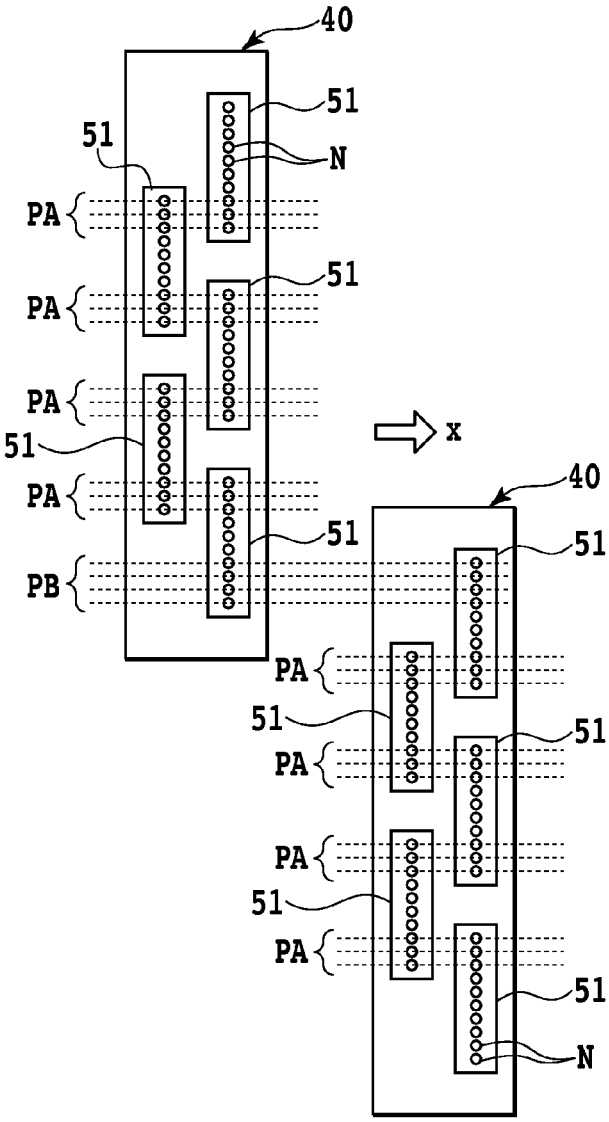
FIG. 2B is a schematic diagram illustrating the arrangement of another example inkjet line head that can be mounted on the inkjet printing apparatus in FIG. 1.

FIG. 2B is a schematic diagram illustrating an example wherein a plurality of the print heads 40 shown in FIG. 2A are arranged in the nozzle array direction (direction in which the nozzles are arranged). In this example, the two print heads 90 are arranged in the nozzle array direction, and at a joint PB of the adjacent print heads 40, the print heads 90 are overlapped such that a predetermined number of nozzles overlap. In the following explanation, the joint PB of the print heads 40 is called a head joint, or simply a joint. The same number, or a different number of nozzles may overlap at the chip joints PA and the head joint PB.

For the sake of convenience, the example in FIG. 2B shows ten chips 51, three nozzles that overlap at the chip joints PA and four nozzles that overlap at the head joint PB. Note, however, that the numerical values are not limited to those employed here.

Since the chip joints PA and the head joint PB do not basically differ with respect to the overlapping of the nozzle arrays, a structure employing a single print head shown in FIG. 2A will now be described. Note, however, that the following description is also applicable to a structure wherein multiple print heads are assembled as shown in FIG. 2B.

Figure 3:
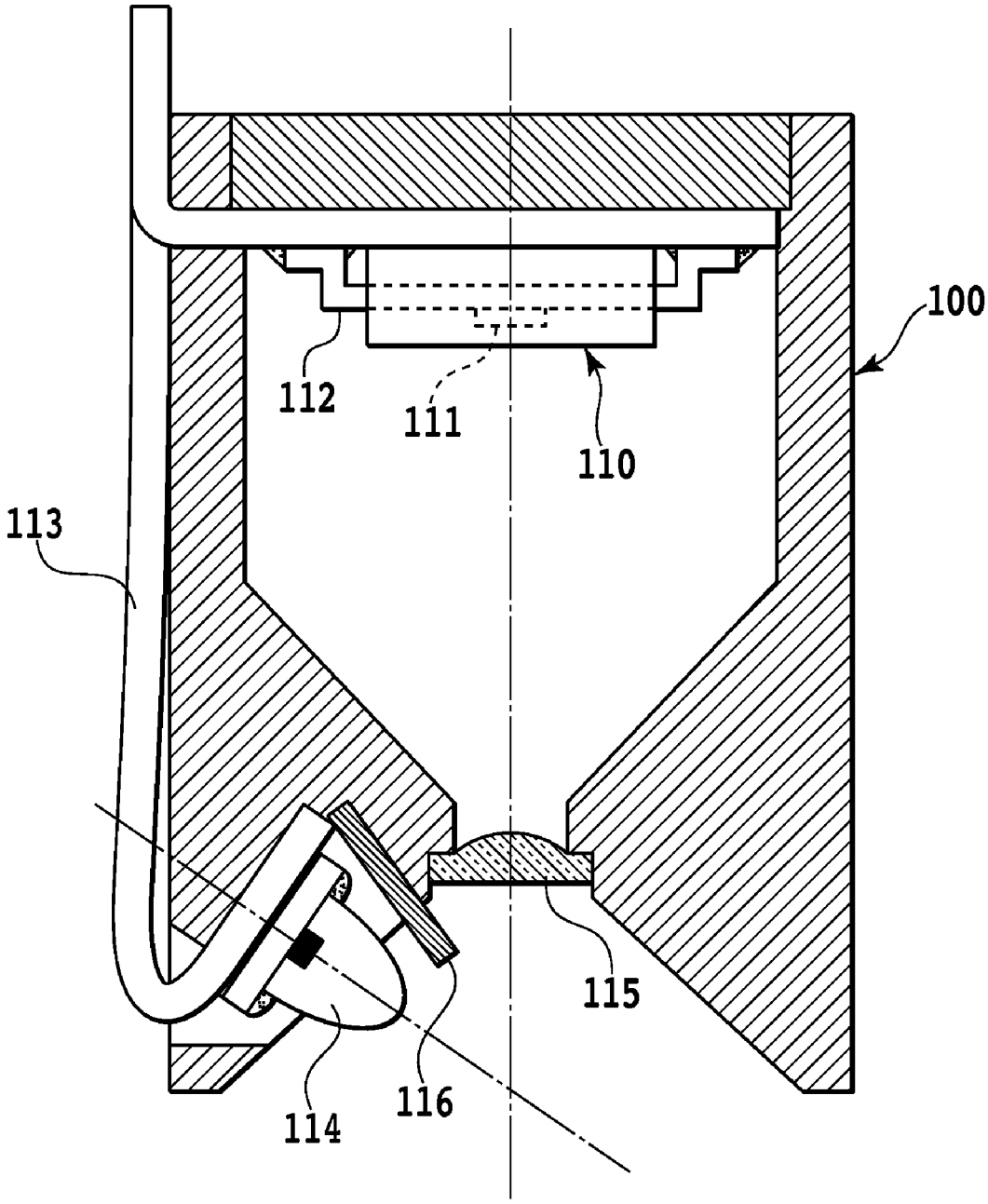
FIG. 3 is a schematic diagram illustrating the structure of the scanning unit of the inkjet printing apparatus in FIG. 1.
Figure 4:
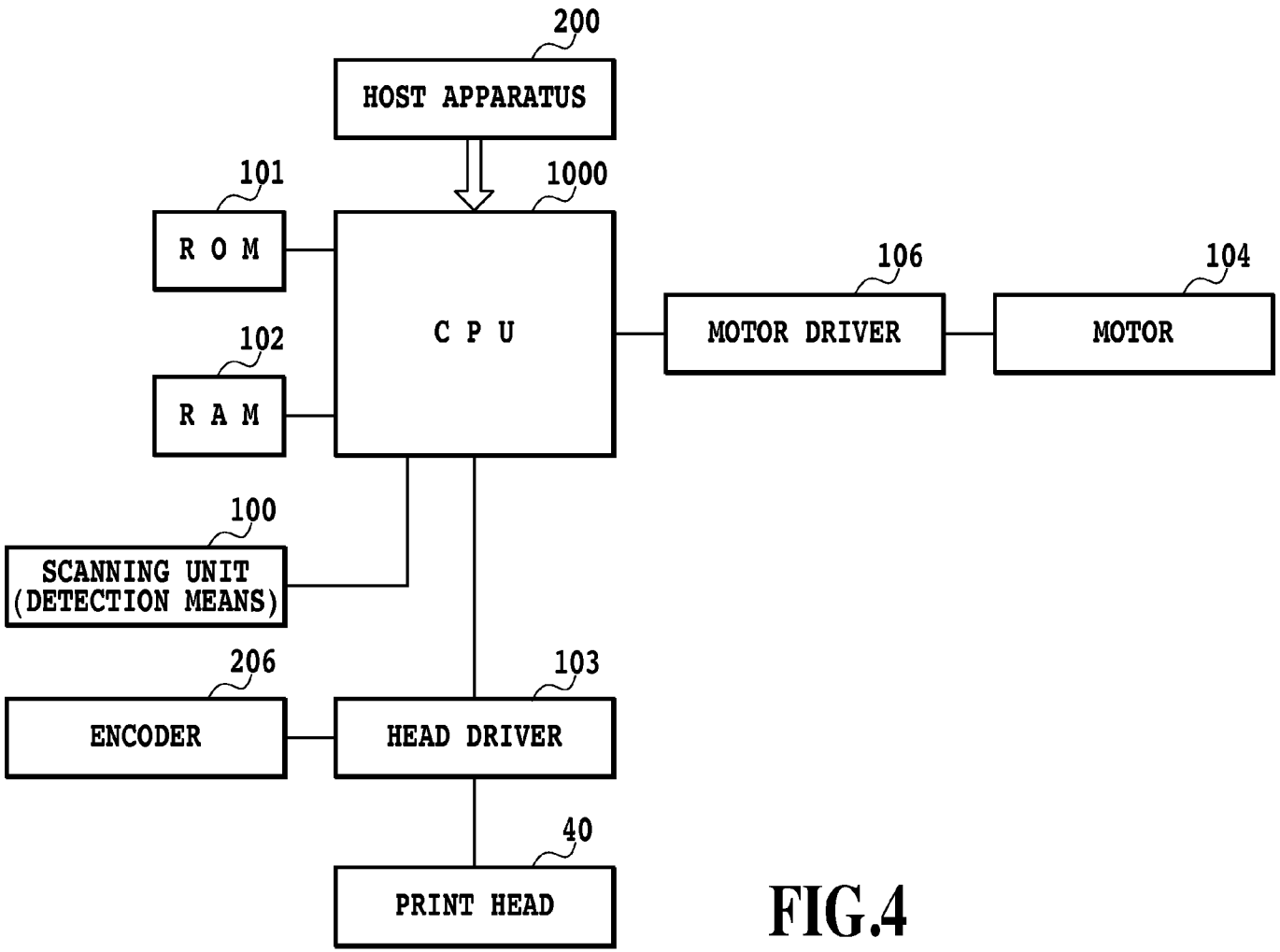
FIG. 4 is a block diagram illustrating the arrangement of the control system for the inkjet printing apparatus in FIG. 1.

FIG. 3 is an explanatory diagram illustrating a scanning unit (detection means) 100 used by the inkjet printing apparatus 1. The scanning unit 100 includes paired light-emitting elements, such as lamps or LEDs, and a photosensor, which may be an optical sensor such as a silicon photodiode (SPD), a phototransistor, a charge coupled device (CCD) or a CMOS sensor. The light-emitting elements emit light onto a check pattern printed on a printing sheet P, and the photosensor receives reflected light and detects the image of the printed check pattern. Then, the detection results are employed to obtain information related to the positions of adjacent chips (registration information) and information related to density fluctuation at a printed image portion corresponding to the chip joint PA. During a process in which the check pattern bearing sheet P is moved in the conveying direction, the scanning unit 100 can obtain information about the results printed by an arbitrary nozzle array.

The photosensor 100 of this embodiment includes a sensor chip 111, mounted on a lead frame 112, and a transparent package 110 that encloses the sensor chip 111. Further, as light-emitting elements, LEDs 114 are mounted on a flexible board 113. The flexible board 113 is a printed circuit board, of a polyimide resin, on which a circuit is printed as a copper foil pattern, and can be flexibly bent into a desired shape. A light blocking plate 116 is used to block light emitted by the LEDs 114, and prevent the light from directly entering a lens 115. The components for the photosensor 110 and the light-emitting element are incorporated in the scanning unit 100.

FIG. 3 is a schematic diagram illustrating the arrangement of the control system of the inkjet printing apparatus 1.

A CPU 1000 controls, via a motor driver 106, a motor 104 for driving the conveyor belt 16, and controls, via a head driver 10A, the print head 40. The CPU 1000, which is a central operating unit, receives print data from a host apparatus 200, and implements control over individual sections of the inkjet printing apparatus 1, and data processing. Further, the CPU 1000 has an image processing function that controls the positioning of dots that are formed by ink droplets ejected by the print head 40. A ROM 101 is used to store processing programs and tables related to the processing procedures implemented by the CPU 1000, and a RAM 102 is employed as a work area by the CPU 1000 while performing the processing procedures. That is, in accordance with the processing programs stored in the ROM 101, the CPU 1000 employs peripheral units, such as the RAM 102, to perform processes, such as a process for converting print information, received from the host apparatus 200, into print data.

Furthermore, the CPU 1000 outputs, to the head driver 103, drive data for the ejection energy generation devices (electrothermal conversion elements (heaters) or piezoelectric elements) of the print head 40, i.e., print data and drive control signals. Based on the drive data that is received, the head driver 103 drives the energy generation devices of the print head 40 to eject ink from the print head 40. It should be noted that part of the functions of the CPU 1000 may be provided by the host apparatus 200.

As previously described, the scanning section 100 measures the light reflected by the image on the printing sheet P, and obtains the reflected density.

Figure 5:
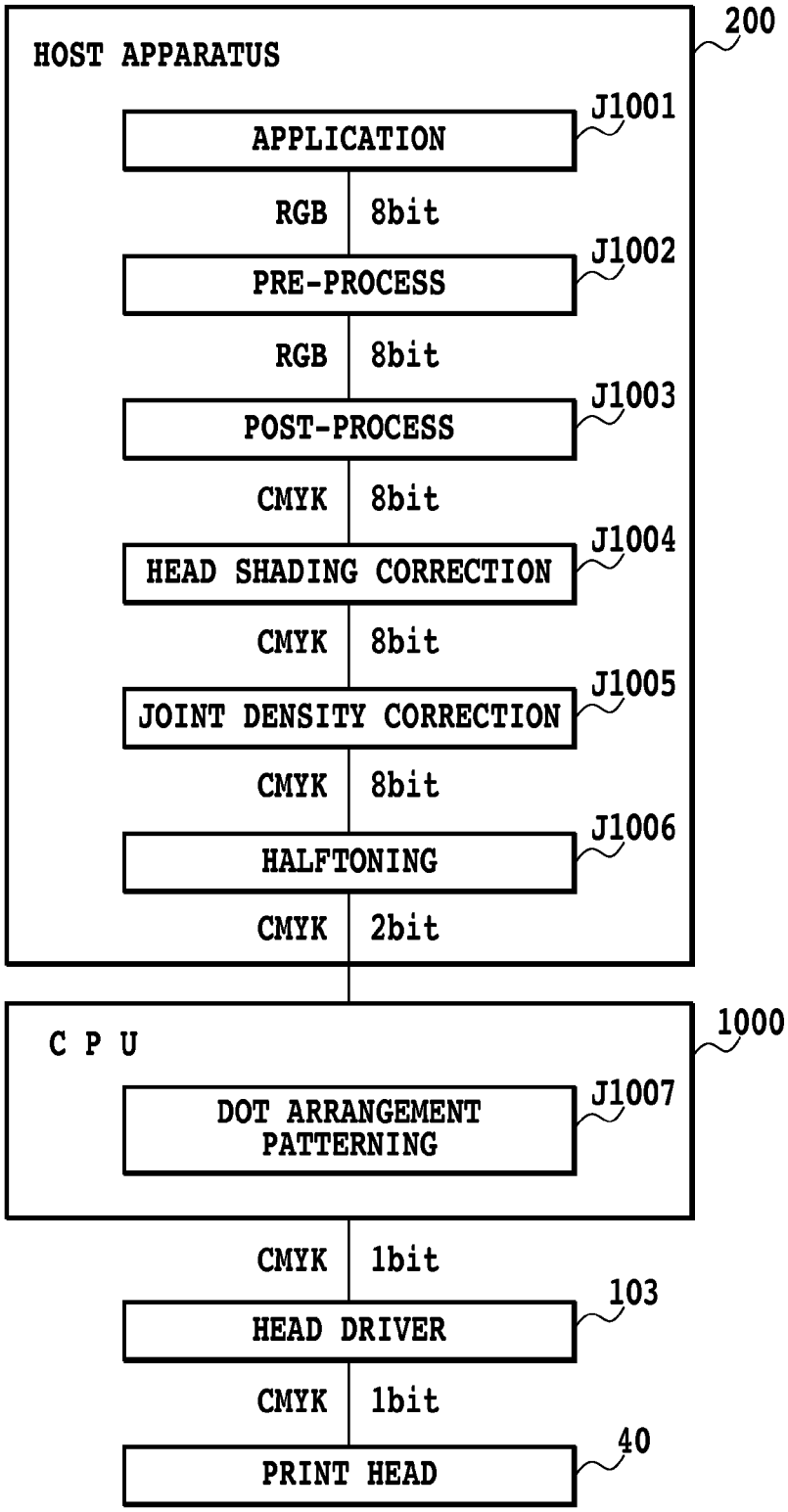
FIG. 5 is an explanatory diagram for a series of image processes performed according to a first embodiment of the present invention.

FIG. 5 is a diagram for explaining the image processing performed by the host apparatus 200 and the inkjet printing apparatus 1.

Programs that are run by the operating system of the host apparatus 200 are, for example, an application and a printer driver. An application J1001 creates image data to be printed by the inkjet printing apparatus 1. The image data, or data before editing, can be fetched via various media to a PC (Personal Computer) that serves as the host apparatus 200. The data fetched by the host apparatus 200 are edited and processed using the application J1001 and R, G and B image data that conform to the color space standard sRGB, for example, are created. These R, G and B image data are then transmitted to the printer driver in compliance with a printing instruction issued by a user.

The processes performed by the printer driver include a pre-process J1002, a post-process J1003, a head shading correction process J1004, a joint density correction process J1005 and a halftoning process J1006.

The pre-process J1002 is the mapping of a color gamut. This is a data conversion process for the mapping, for example, of a represented color gamut, based on the R, G and B image data of the sRGB color space standard, into the representative color gamut of the inkjet printing apparatus 1. Specifically, a three-dimensional LUT is employed, and 8 bit image data R, G and B representing 256 gradations are converted into 8-bit R, G and B data for the color gamut of inkjet printing apparatus 1. In the post-process J1003, the 8-bit R, G and B data that are mapped in the color gamut are employed to obtain 8-bit color separation data for four colors that are consonant with a set of ink colors that express the color represented by these R, G and B data. That is, Y, M, C and K color separation data is obtained.

In the head shading process J1004, the density value (gradation level) is changed for data for each color represented by the color separation data that is obtained by the post-process J1003. In the joint density correction process J1005, as discussed later, the image scanning results of the test pattern are employed to correct the print density of the images printed at the chip joints.

In the halftoning process J1006, quantization is performed to convert into 4-bit data the individual 8-bit color separation data Y, M, C and K obtained from the head shading process J1004. For example, the 8-bit data for 256 gradation levels are converted into 2-bit data for four gradation levels using the error diffusion method. The 2-bit data serves as an index that depicts an arrangement pattern in the dot arrangement patterning process performed by the inkjet printing apparatus 1, that will be described later. At the end of the processing, the printer driver adds print control data to the image data that depicts the 2-bit index data, and provides print data (the print data preparation process).

The CPU 1000, of the inkjet printing apparatus 1, performs the following dot arrangement patterning process J1007 for the print data received from the host apparatus 200.

In the above described halftoning process J1006, gradation of data reduced, i.e., multi-level density data (8-bit data) for 256 gradation levels, is changed to 4-level gradation data (2-bit data). However, the data that can be printed by the inkjet printing apparatus 1 is binary data (1-bit data), that determines whether or not an ink dot is formed. Therefore, in the dot arrangement patterning process J1007, each pixel represented by 2-bit data, for gradation levels 0 to 9, that is an output value in the halftoning process J1006, is allocated a dot pattern that corresponds to the gradation levels (levels 0 to 4) of the pixel. Therefore, the printing or not printing of an ink dot (dot ON/OFF) is defined for the individual areas of a pixel, and binary data for one bit, a "1" or "0", is assigned for each of these areas of the pixel. In this case, a "1" is binary data indicating that a dot be printed, and a "0" is binary data indicating that a dot not be printed.

When the head driver 103 drives the print head 40 based on such binary data, a desired image can be printed.

The relationship between a chip joint and a joint defective line will now be described.

Figure 6:
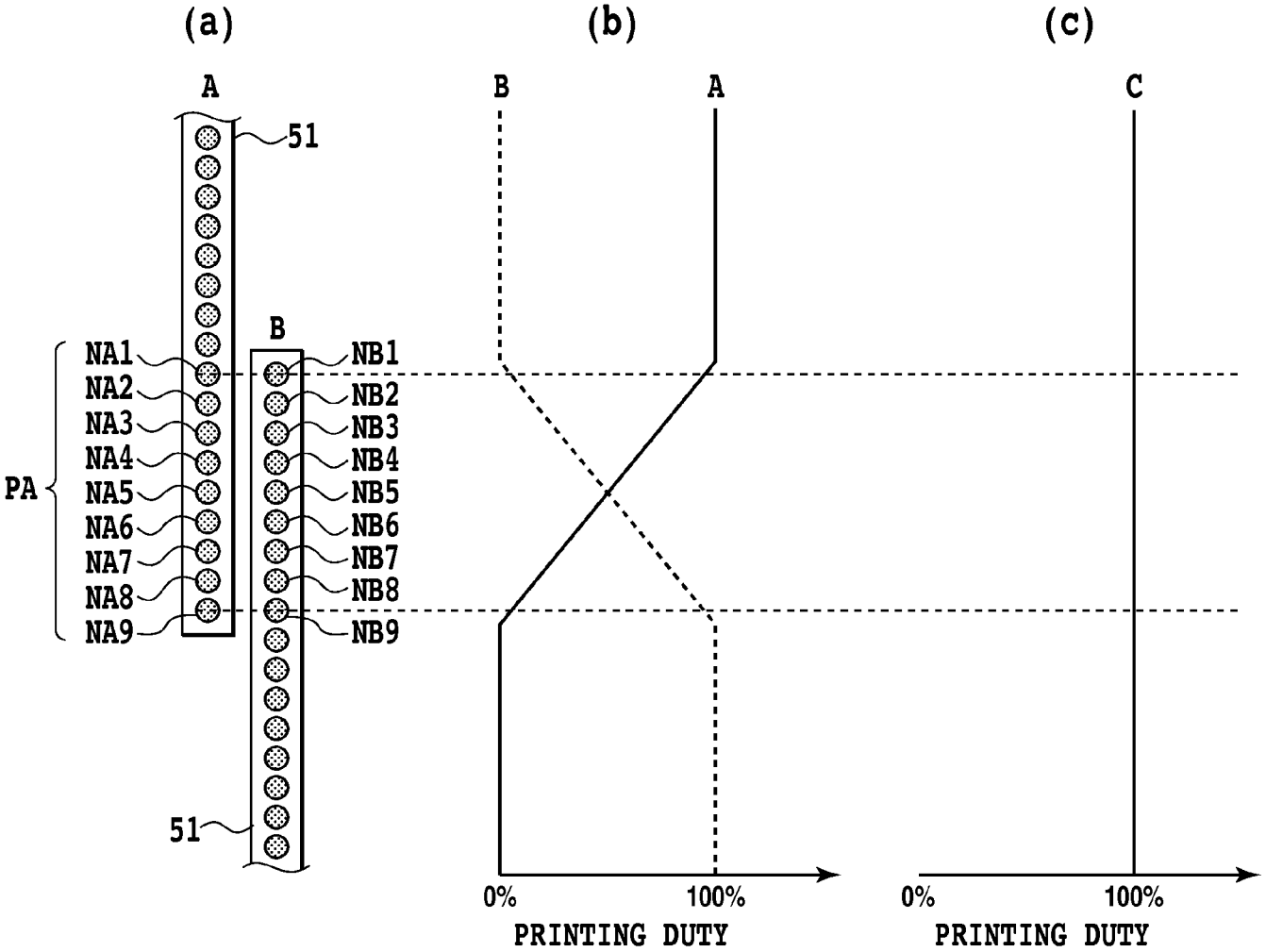
FIG. 6 is a diagram for explaining a relationship among a joint of aligned chips, a ratio of printing duties at the joint, and the total printing duty at the joint.

FIG. 6 is diagram for explaining an example structure for the print head 40 of this embodiment. In this example, nine nozzles are overlapped at the joint PA.

Assume that, as shown in a left portion (a) of FIG. 6, the adjacent chips 51 are a chip A and a chip B, and that the nozzles N of the chip A that overlap at the joint PA are denoted by NA1 to NA9, and that the nozzles N of the chip B that overlap at the joint PA are denoted by NB1 to NB9. With this structure, the printing duty proportioning method (also called a "gradation mask") described in Japanese Patent Laid-Open No. H05-57965 (1993), is employed to form an image at a head joint PA. That is, when forming an image at the head joint PA, the printing duty ratio (use frequency ratio) of the overlapped nozzles of the chips A and B is changed in accordance with the positions of these nozzles. Specifically, as shown in a central portion (b) of FIG. 6, the print density of dot is gradually reduced, in the named order, for the nozzles NA1 to NA9 of the chip A, and to supplement this print density reduction, the print density of dot is gradually increased, in the named order, for the nozzles NB1 to NB9 of the chip B. That is, in the overlapped portion of the nozzle arrays of the chips A and B, the print density of dot (printing duty) of one nozzle array is gradually reduced in one direction along the nozzle array, and the print density of the other nozzle array is gradually increased in the same direction. When, for example, the printing duty ratio of the nozzles NA5 and NB5 is 50:50, to print an image, these nozzles mutually undertake 50% of the printing duty. Further, the printing duties for nozzles NA1 to NA9 are greater than those for the nozzles NB1 to NB4, and the printing duties for the nozzles NA6 to NA9 are smaller than those for the nozzles NB6 to NB9. Therefore, the total printing duty at the joint PA is 100%, as shown in a right portion (c) of FIG. 6. Since this is also applicable for a line type print head (a multi-segment print head) wherein, as shown in FIG. 2B, the multi-chip print heads 40 are coupled along the nozzle arrays, the multi-segment print head is employed in the description below.

Figure 7:
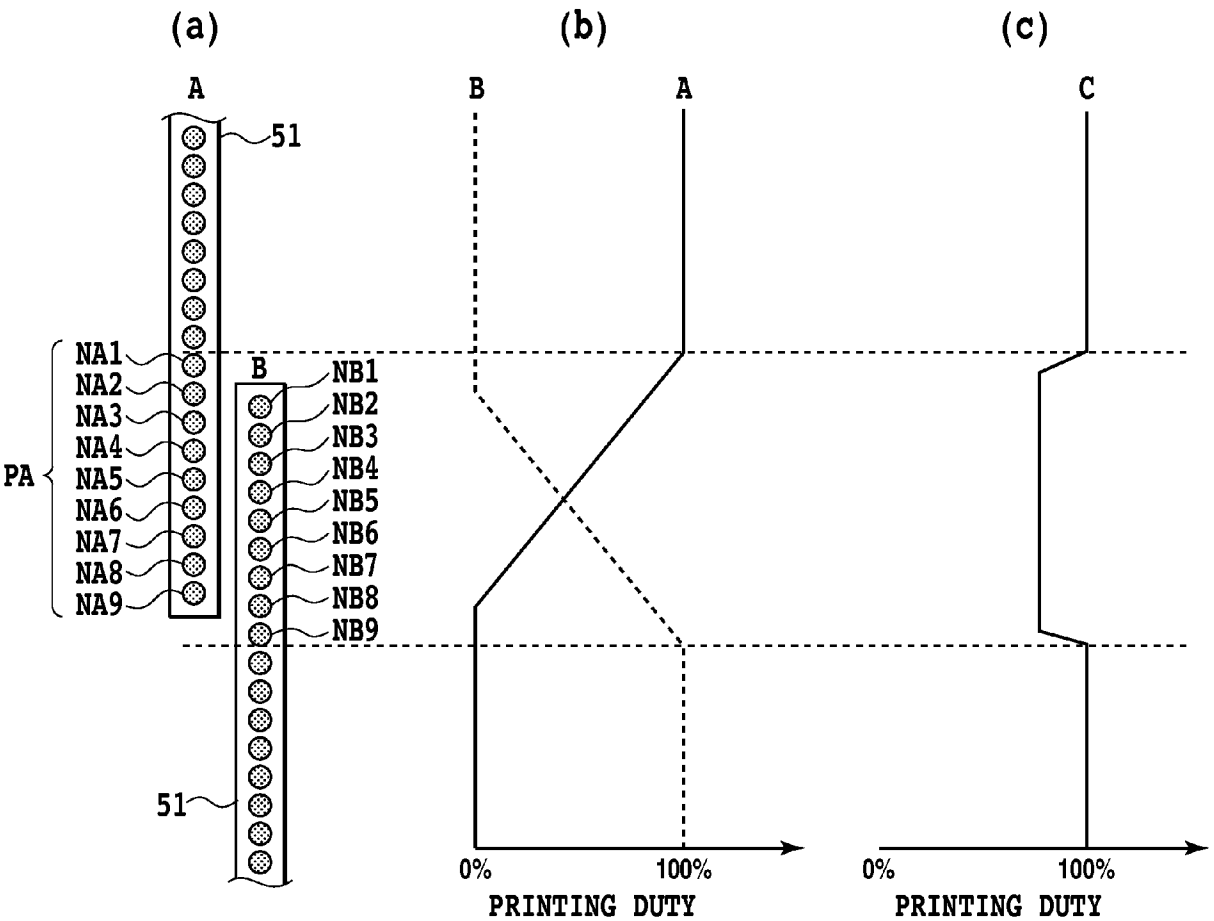
FIG. 7 is a diagram for explaining a relationship among a joint of misaligned chips, a ratio of printing duties at the joint, and the total printing duty at the joint.

FIG. 7 is an explanatory diagram of a case, for the print head 40 of this embodiment, wherein misalignment of the chips at the joint PA causes the dislocation of ink landing positions for the portion of the image formed that corresponds to the joint PA. The main causative factor in the misalignment of chips can be either a chip mounting error occurring during the manufacture of a print head, or the attachment at an incorrect angle of a print head to an inkjet printing apparatus.

The example in a left portion (a) of FIG. 7 shows an occurrence of misalignment in the positioning between Chip A and Chip B in the nozzle array direction leading from the chip A toward the chip B. As shown in a central portion (b) of FIG. 7, the printing duty at the joint PA of the chips A and B is the same as that for the case in the central portion (b) of FIG. 6, where misalignment does not occur. However, since the chips A and B are misaligned in the direction leading from the chip A toward the chip B, the average printing duty at the joint PA becomes lower than the average printing duty at portions other than the joint PA, as shown in a right portion (c) of FIG. 7. Therefore, the image portion is printed at a low print density by the nozzles at the joint PA, and as a result, a light line-like image defect (a white line) could appear. On the other hand, when the chips A and B are misaligned in a direction leading from the chip B toward the chip A, the average printing duty at the joint PA is increased.

When the chips are misaligned as described above, the total printing duties D for the two chips at the joint PA can be represented using the following equation (1). It should be noted that in equation (1), L denotes the width of the joint PA and A denotes a deviation from the accurate alignment of the two chips in the nozzle array direction. A can be either a positive or negative value. Further, in this embodiment, a deviation value when the two chips are misaligned in the direction leading from the chip A toward the chip B is defined as a positive value. Therefore, (L−A) is an overlap distance for the two chips A and B. Furthermore, a total printing duty of 100% is allowed for.

$$(L-A)/L\times 100=D(\%) \quad (1)$$

Two calculation examples will now be described.

(Calculation Example 1)

When the width L of the joint PA of the two chips is defined as equivalent to 32 pixels, L=32, and the two chips are misaligned a distance of ½ pixel in the direction leading from the chip A toward the chip B, the deviation A in the nozzle array direction is A=½, because the direction leading from the chip A toward the chip B is defined as the positive direction. When these values are substituted into equation (1), the total printing duty D at the joint PA is (32−½)/32×100=98.4(%). This indicates that due to the misalignment of the chips, the total printing duty at the joint PA before the misalignment occurred, 100%, is reduced by 1.26%.

(Calculation Example 2)

Assume that the width L of a joint PA of two chips is equivalent to 64 pixels, L=64. When the two chips are misaligned a distance equivalent to two pixels in a direction leading from the chip B toward the chip A, the deviation A is A=−2 because the direction from the chip A toward the chip B is defined as the positive direction. When these values are substituted into equation (1), the total printing duty D at the joint PA is (64−(−2))/64×100=103.1(%). This indicates that, due to the occurrence of the misalignment, the total printing duty at the joint PA before the misalignment occurred, 100%, is increased by 3.1%.

As is apparent from this description, because of the occurrence of the misalignment of the chips, the printing duty at the joint PA is either higher, or lower than the printing duty at portions other than the joint. Therefore, a dark line image defect (a black line) or a light line image defect (a white line) could appear in the image portion formed by the nozzles at the joint PA. In the following explanation, the white line or the black line image defect is also called a joint line defect.

This joint line defect can be reduced using the above described gradation mask; however, when the misalignment of the chips is too great, the image quality is in danger of being deteriorated.

Figure 8:
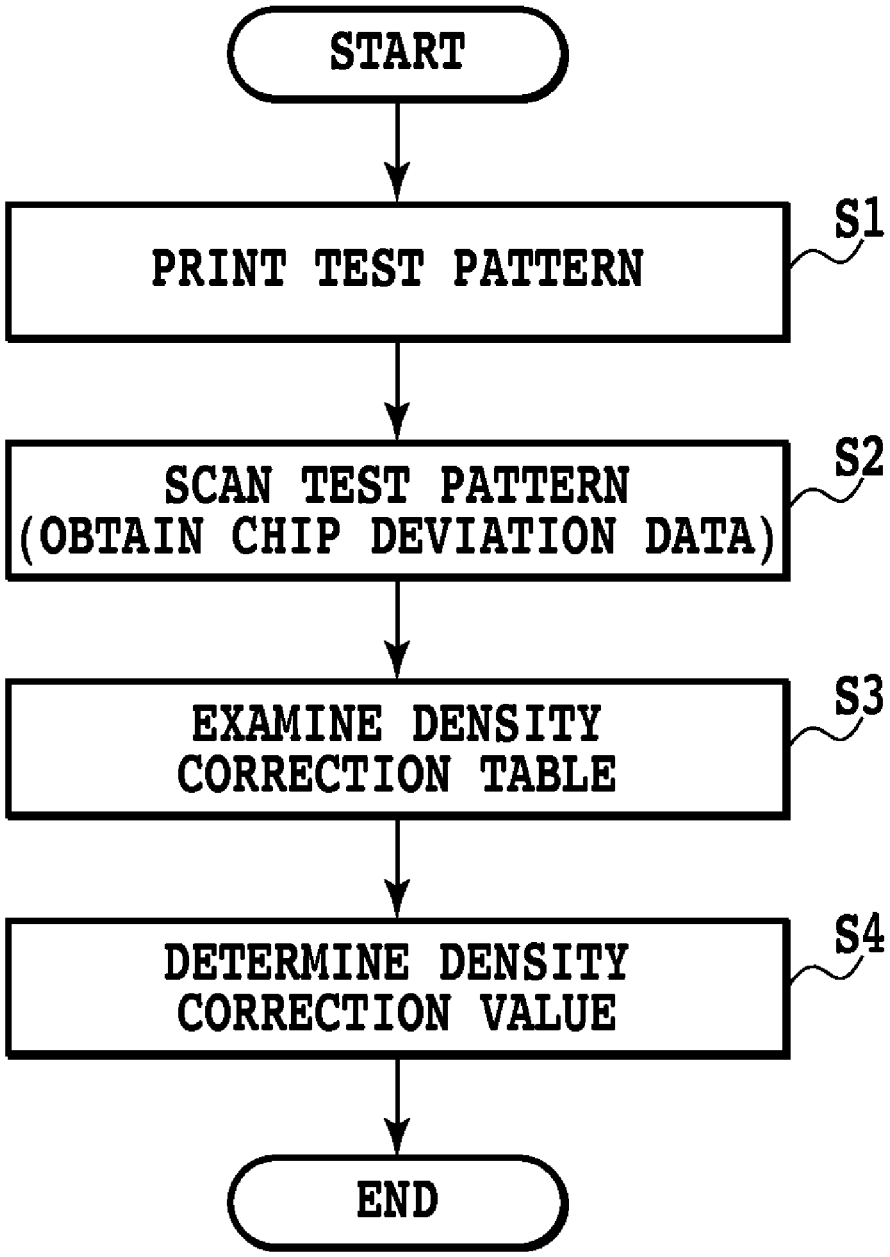
FIG. 8 is a flowchart for explaining the density correction value determination processing performed for the first embodiment of the present invention.

In this embodiment, the processing in FIG. 8 will be performed to print a high quality image, regardless of the deviation from the accurate alignment of the chips.

Specifically, a test pattern, which will be described later, is printed in order to obtain information related to misalignment of the chips causing a joint line defect (step S1). Next, the scanning unit 100 scans the image of the test pattern, and employs the scanned image to calculate the extent of any deviation between the chips (step S2). Next, as described later, a density correction table is referenced (step S3) to determine an appropriate density correction value to use for correcting the joint line defect (step S4). The density correction can be performed at any time, but preferably this process is performed when a printing apparatus is initially installed, when a print head is mounted, or when a registration value is changed due to the transfer or the aging of the printing apparatus.

(Test Pattern)

Figure 9:
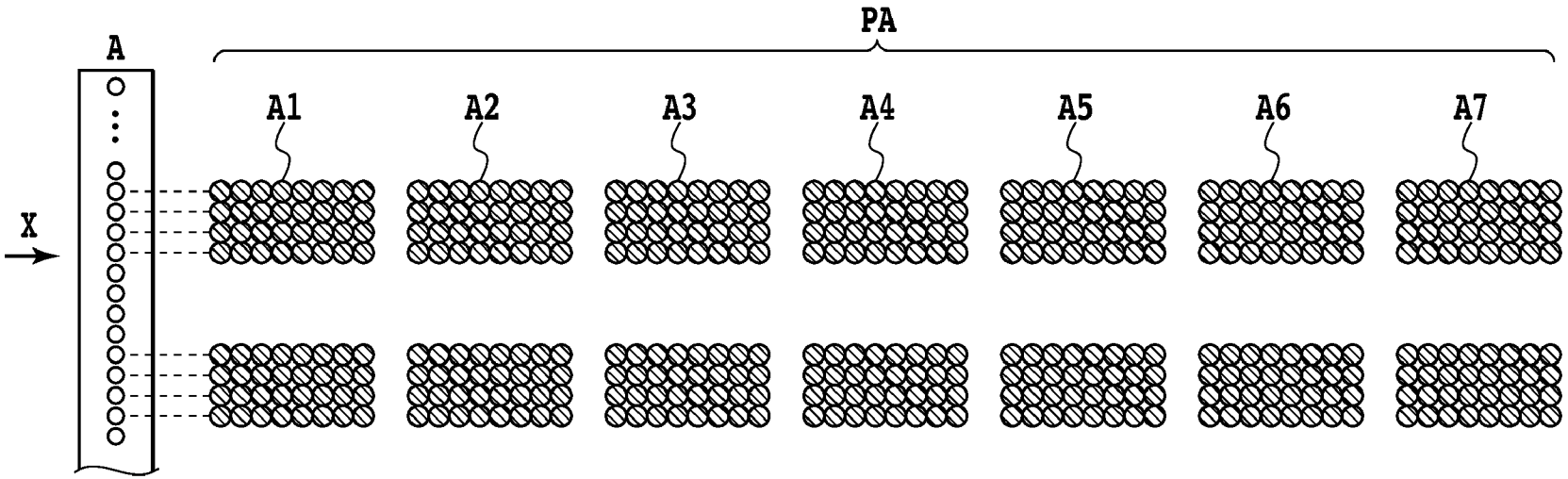
FIG. 9 is a diagram for explaining a pattern, for the first embodiment of this invention, printed by one of the adjacent chips.
Figure 10:
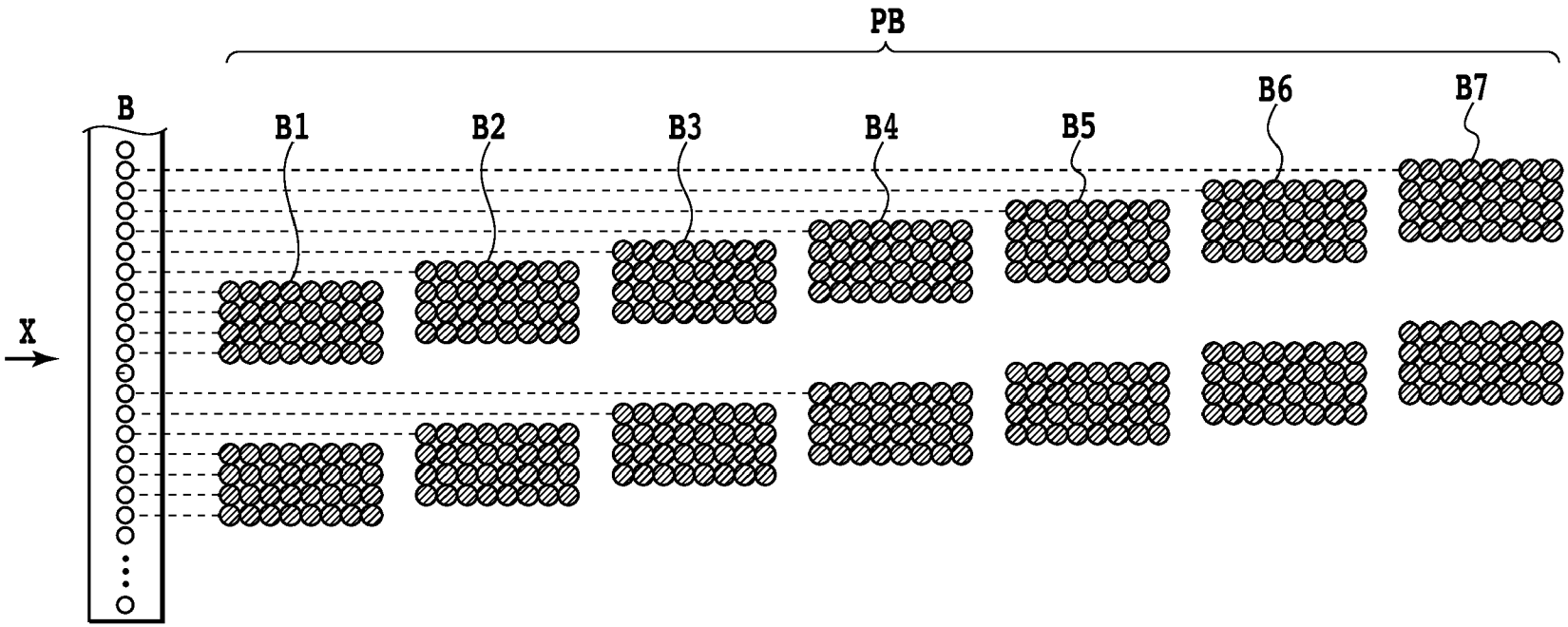
FIG. 10 is a diagram for explaining a pattern, for the first embodiment of this invention, printed by the other adjacent chip.
Figure 11:
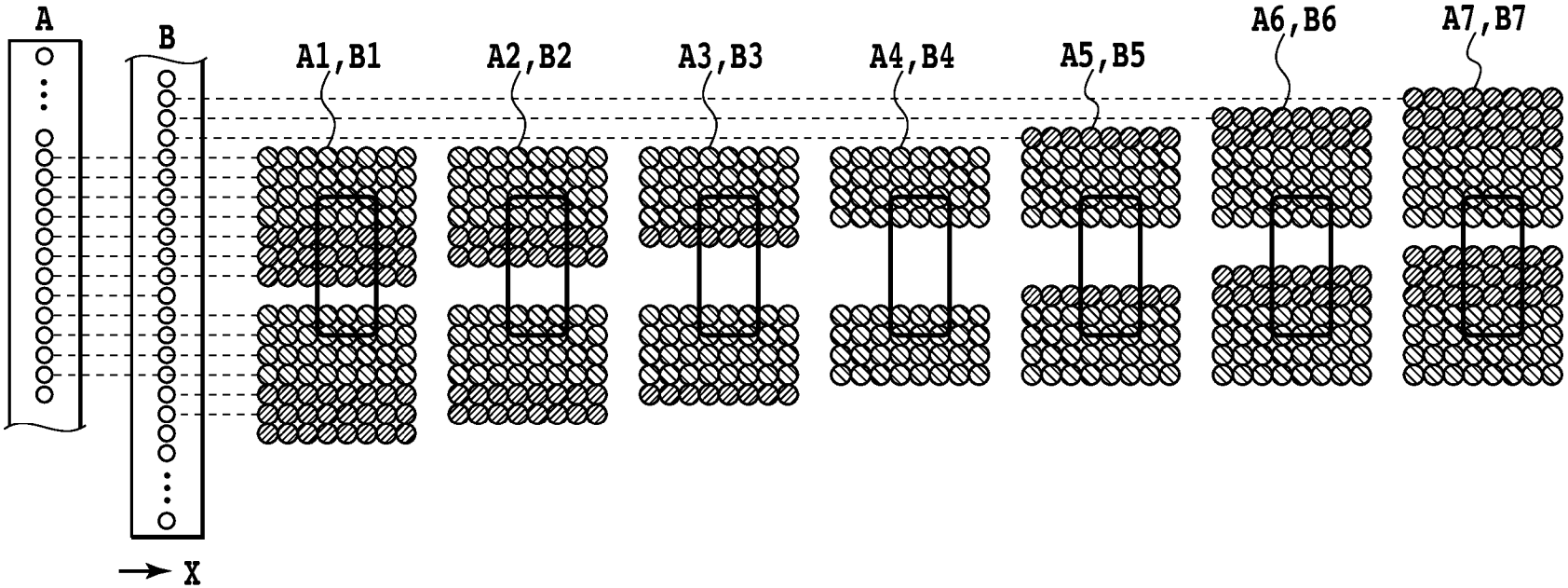
FIG. 11 is a diagram for explaining a test pattern obtained by superimposing the patterns in FIGS. 9 and 10.

FIGS. 9 to 11 are diagrams for explaining test patterns for detecting positional deviation between the chips. FIG. 9 is an explanatory diagram for an example test pattern printed by the chip A, and FIG. 10 is an explanatory diagram for an example test pattern printed by the chip B. FIG. 11 is an explanatory diagram for a test pattern obtained by printing the patterns in FIGS. 9 and 10 at the same time.

First, an example pattern (FIG. 9) printed by the chip A will be described.

A dot pattern consisting of four pixels in the nozzle array direction and eight pixels in the sheet conveying direction (indicated by an arrow X) is printed using the chip A, and another dot pattern consisting of four pixels in the nozzle array direction and eight pixels in the conveying direction is printed at a distance equivalent to four pixels from the first dot pattern in the nozzle array direction. These two dot patterns are regarded as pattern A1, and the same is repeated in the conveying direction to print the remaining seven patterns A1, A2, A3, A4, A5, A6 and A7. That is, the seven patterns are arranged in the sheet conveying direction.

Next, an example pattern (FIG. 10) printed by the chip B will be described.

Chip B is employed to print a total of seven patterns, shown in FIG. 10, B1, B2, B3, B4, B5, B6 and B7. These seven patterns are arranged in the conveying direction. The pattern B4 is printed via the nozzles of chip B that overlap with the nozzles of chip A, which were used for printing the patterns A1 to A7, at the same relative location as the pattern A4. The pattern B1 is printed at a location that is shifted away from the pattern B4 a distance equivalent to −3 pixels (3 pixels in the direction leading from the chip B toward the chip A). Similarly, the pattern B2 is printed at a location that is shifted away from the pattern B4 a distance equitant to −2 pixels, and the pattern B3 is printed at a location that is shifted away from the pattern B4 a distance equivalent to −1 pixel. Pattern B5 is printed at a location shifted away from the pattern B4 a distance equivalent to +1 pixel (one pixel in the direction leading from the chip A toward the chip B). Likewise, the pattern B6 is printed at a location shifted away from the pattern B4 a distance equivalent to +2 pixels, and the pattern B7 is printed at the location shifted away from the pattern B4 a distance equivalent to +3 pixels.

FIG. 11 is an explanatory diagram for a test pattern obtained by printing the patterns in FIGS. 9 and 10 at the same time. The test pattern result shown in FIG. 11 is printed when the chips A and B are aligned.

In FIG. 11, the pattern A4 and the pattern B4 are overlapped. However, the pattern A3 and the pattern B3 are shifted in the nozzle array direction a distance equivalent to −1 pixel, the pattern A2 and the pattern B2 are shifted a distance equivalent to −2 pixels, and the pattern A1 and the pattern B1 are shifted a distance equivalent to −3 pixels. Furthermore, the pattern A5 and the pattern B5 are dislocated in the nozzle array direction a distance equivalent to +1 pixel, the pattern A6 and pattern B6 are shifted a distance equivalent to +2 pixels, and the pattern A7 and the pattern B7 are shifted a distance equivalent to +3 pixels.

(Chip Deviation Information)

The rectangular frames in FIG. 11 are scanning areas (measurement areas) for the scanning unit 100. The scanning of a scanning area by the scanning unit 100 is performed in order to measure the density of the test pattern in the measurement area. For the case wherein dots that form the patterns are aligned, as in the overlapped portions of the pattern A4 and the pattern B4, the portion in which dots are formed is small, about half the measurement area, and the measured density is low. On the other hand, for the case wherein dots that form the patterns are shifted, as in the overlap portions of the patterns A1 and B1, the density in the measurement area is increased.

Figure 12:
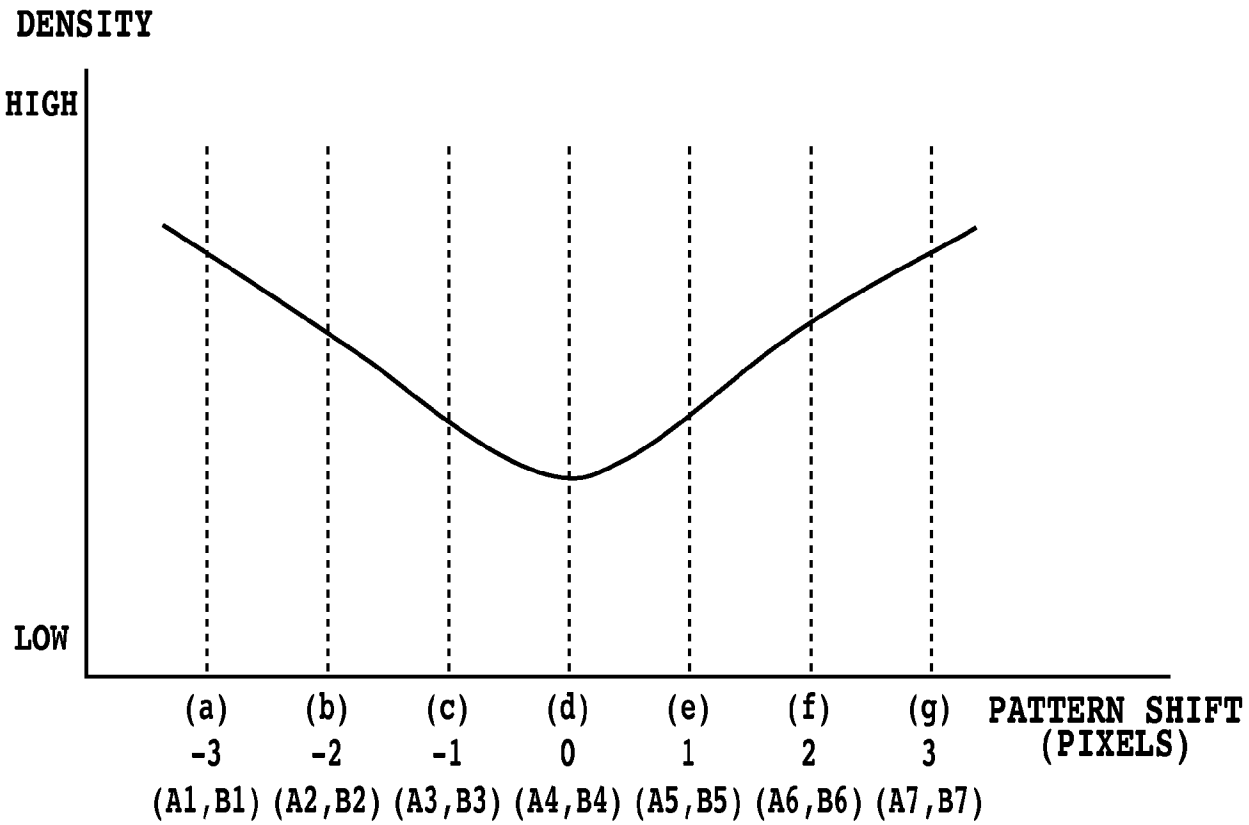
FIG. 12 is a graph for explaining the results obtained by scanning the test pattern in FIG. 11.

FIG. 12 is a graph obtained by plotting the reflection densities of the measurement areas of the test pattern in FIG. 11. The vertical axis in FIG. 12 represents reflection density, and the horizontal axis represents the shift between patterns printed by the chips A and B, which corresponds to the deviation between the chips A and B.

The scanning unit 100 measures the reflection density of a test pattern in a measurement area, to determine the extent of the shifting of a test pattern with a low reflection density. In this manner, the deviation between the chips A and B can be determined. Furthermore, the interpolation method can be employed to detect a deviation equal in size to or smaller than one pixel.

The chip deviation information is stored in the RAM 102, and is employed for density correction. Before a print head is shipped, a deviation between chips may be measured and stored in the ROM 101 in advance.

Next, a density correction table and a density correction method will be separately described for correcting the density of the image portion printed at the chip joint.

(Density Correction Table)

FIG. 13 is a density correction table used in a density correction process. The density correction table is a matrix that correlates deviation between chips in the nozzle array direction and a printing duty, and is used to obtain density correction values that correspond to chip deviation.

The relationship between chip deviation and printing duty is calculated using equation (1). Since the width L of the joint PA of the chips A and B is equivalent to 32 pixels, L=32. In this case, the chip deviation A ranges from −1.5 pixels to +1.5 pixels, and the value for the deviation A is substituted into equation (1) to calculate the printing duty for the joint PA correlated with the chip deviation A. The density correction value, used for correcting a change in the printing duty that is caused by chip deviation, is obtained by calculating the inverse of the printing duty that is correlated with the chip deviation.

For example, when the chips A and B are misaligned a distance equivalent to 0.5 pixel in a direction leading from the chip A toward the chip B, the total printing duty D at the joint PA is $(32-0.5)/32\times100=98.4(\%)$ using equation (1). The inverse of this value is the density correction value, 101.6%. The table in FIG. 13 is for deviations equivalent to ±1.5 pixels. However, the chip deviation values available for a density correction table are not particularly limited to the arbitrary limits employed.

The density correction table is stored in the ROM 101, and as previously described, and the density value is corrected through the joint density correction process J1005 performed by the host apparatus 200. Alternatively, equation (1) may be stored in the ROM 101, and the CPU 1000 of the inkjet printing apparatus 1 may calculate a density correction value based on the chip deviation. In either case, the density correction value can be determined based on the chip deviation.

(Density Correction Method)

Figure 14:
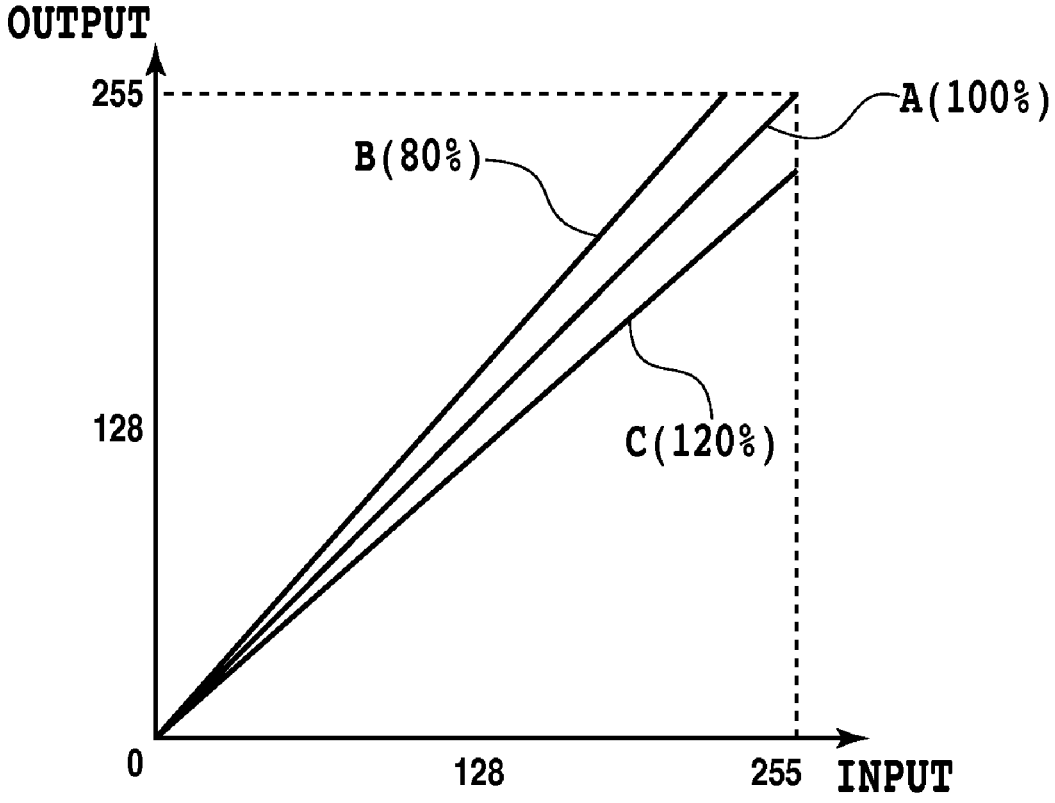
FIG. 14 is a diagram for explaining a density correction value for the first embodiment of the present invention.

FIG. 14 is a graph showing an example of conversion tables for 8-bit image data. The horizontal axis represents an input value and the vertical axis represents an output value that has been corrected. A value of "0" corresponds to black, and a value of "255" corresponds to white. "A" in FIG. 14 is a conversion table that does not perform any corrections. For an input value of 0, the output value is 0, for an input value of n, the output value is n, and for an input value of 255, the output value is 255. "B" in FIG. 14 is a conversion table that performs correction to increase the density of an output image by 20%. For an input value of 0, the output value is 0, and for the other input values, a (input value)<(output value) relationship is established. It should be noted, however, that the maximum output value is fixed at 255. "C" in FIG. 14 indicates a conversion table that performs correction to decrease the density of an output image by 20%. For an input value of 0, the output value is 0, and for the other input values, a (input value)>(an output value) relationship is established. When the image density is even, correction is not required and the conversion table A in FIG. 14 is employed.

When printing is performed without density correction for chips that are misaligned in the direction leading from chip B to chip A, black lines may appear in the portion of the image printed by the chip joint. In this case, the density is lowered using the conversion table C in FIG. 14, and the adverse affect caused by the chip deviation can be restrained. When printing is performed without density correcting for chips that are misaligned in the direction leading from the chip A to the chip B, white lines may appear in the portion of the image printed by the chip joint. In this case, the density is increased using the conversion table B in FIG. 19, and the adverse affect caused by the chip deviation can be restrained.

Therefore, for the case wherein the chips are misaligned in a direction leading from the chip B toward the chip A, and the total printing duty at the chip joint is increased, the density of the original image is reduced when printing, such that adverse affect by the chip deviation is restrained, and an image of high quality can be printed. On the other hand, when the chips are misaligned in a direction leading from the chip A toward the chip B and the total printing duty at the chip joint is decreased, the density of the original image is increased when printing, so that the affect by the chip deviation can be avoided, and an image of high quality can be printed. In FIG. 14, three conversion tables A, B and C are shown for simplification of the explanation. However, the number of conversion tables can be increased for more finely tuned correction. For example, conversion tables can be prepared corresponding to the density correction values entered in the density correction table of FIG. 13.

When using this density correction method, the density correction is uniformly performed with respect to the output values of the image printed by the chip joint PA, and the output values of the image printed by the joint PA are equally increased or reduced. Therefore, the density difference between the joint and the other portions of the chips is decreased, and the occurrence of the joint line defect can be reduced.

Second Embodiment

The arrangement of an inkjet printing apparatus for a second embodiment of the present invention is the same as that for the first embodiment. The primary difference from the first embodiment is that a method for preparing a density correction table is included. In the first embodiment, density correction values are theoretically calculated using equation (1), and a density correction table is prepared. In this embodiment, a density correction value is determined based on the results of printing patch images, to prepare a density correction table. It should be noted that, at the developmental stage of an inkjet printing apparatus, the density correction table is prepared by using developmental tools and changing the deviation value between chips.

The density correction table preparation method for this embodiment will now be described by employing FIG. 15.

Figure 15:
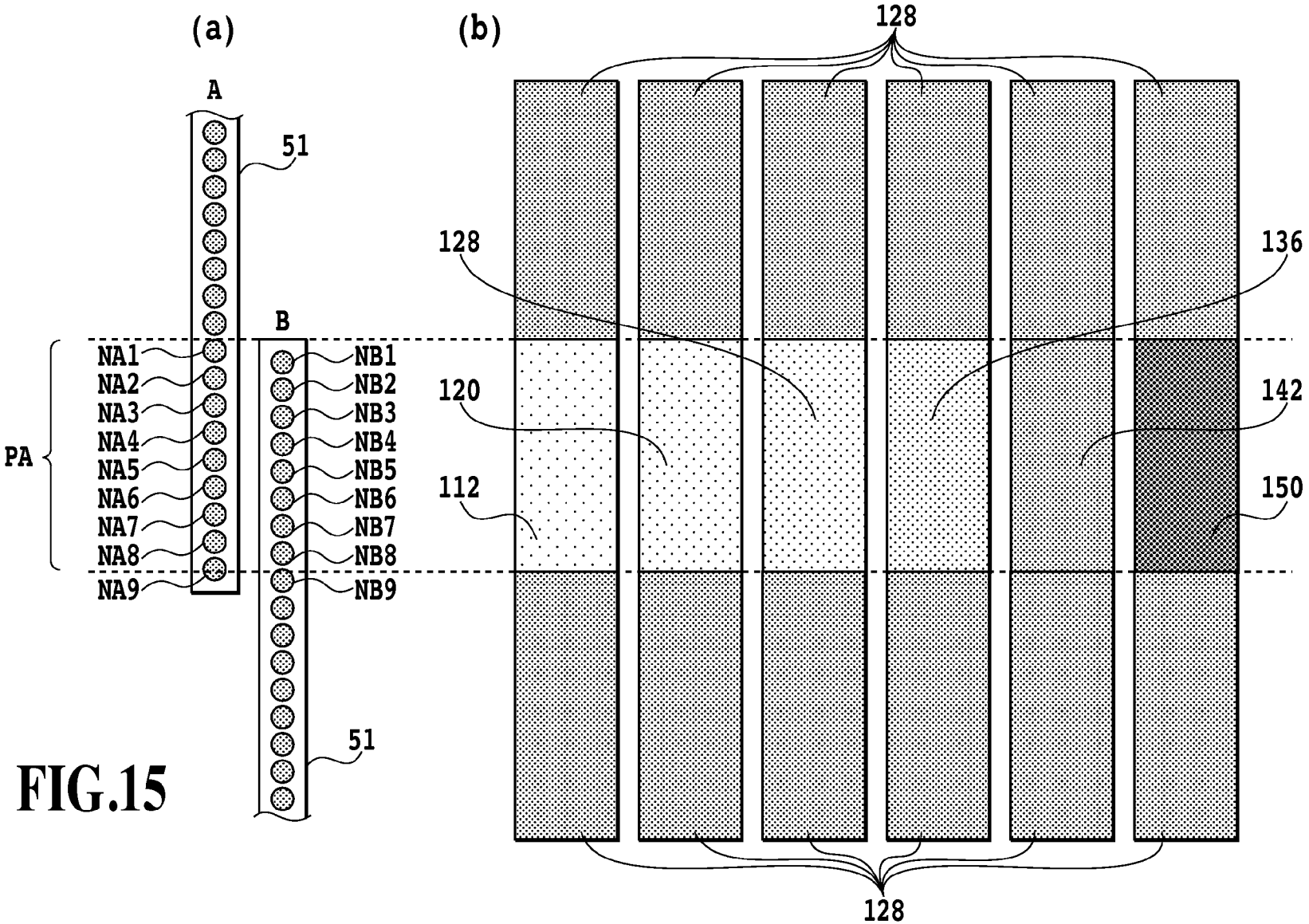
FIG. 15 is an explanatory diagram for image patches according to a second embodiment of the present invention.

A left portion (a) of FIG. 15 shows a state wherein chips A and B are misaligned in a direction leading from the chip A toward the chip B. In this case, print density at chip joint PA is reduced, and a white line tends to appear. Therefore, as shown in a right portion (b) of FIG. 15, a plurality of pattern image patches are printed by fixing an image input value at 128 for portions other than the joint PA, and varying the image input values for the joint PA by multiples of 8, from 122 to 150. It should be noted that arbitrary image input and variability values can be employed to print image patches, and by employing a smaller variability value a more accurate density correction value can be obtained.

After these pattern image patches have been printed, the density of the image portion at the joint PA of each image patch is compared with the density of the image portion at other portions, and the pattern image patch, for which the densities in the image portions are the nearest, is selected visually, or using a density measurement device. Then, based on the input values used to print the selected pattern image patch, a density correction value that is correlated to the deviation between the chips A and B is calculated. That is, the image input value for the joint PA is divided by the image input value for portions other than the joint PA, and the resultant value, represented by a percentage, is a density correction value correlated with a deviation between the chips A and B.

Assume, for example, that when an image value of 142 is input for the joint PA and an image value of 128 is input for portions other than the joint PA, the density of the image portion at the joint PA is nearest to the density of the image at the other portions. In this case, 111(%) (=142/128×100) is the density correction value.

The above described process is performed repeatedly while using development tools to change chip deviation, and a density correction values can be obtained in correlation with an arbitrary deviations. Through this experimental method, the same table as the density correction table in FIG. 13 can theoretically be prepared. When the density correction values are stored in the ROM 101, and a density correction method, as in the first embodiment, is employed, the density of the image portion at the joint PA can be corrected.

Third Embodiment

The arrangement of an inkjet printing apparatus for a third embodiment of the present invention is the same as that for the first embodiment. The primary difference from the first and second embodiments is that a density correction table is not prepared.

In this embodiment, as well as in the second embodiment, a density correction value is determined based on the results from printing image patches. For example, when chips A and B are misaligned as in the left portion (a) of FIG. 15, the image input value for portions other than the joint PA is fixed at 128, while the image input value for the joint PA is varied by multiples of 8, from 122 to 150, and a plurality of pattern image patches are printed. It should be noted, however, that arbitrary image input and variability values and can be employed in connection with print image patches, and when the variability is small, a more accurate density correction value can be obtained. The print data for image patches are stored in the ROM 101.

Figure 16:
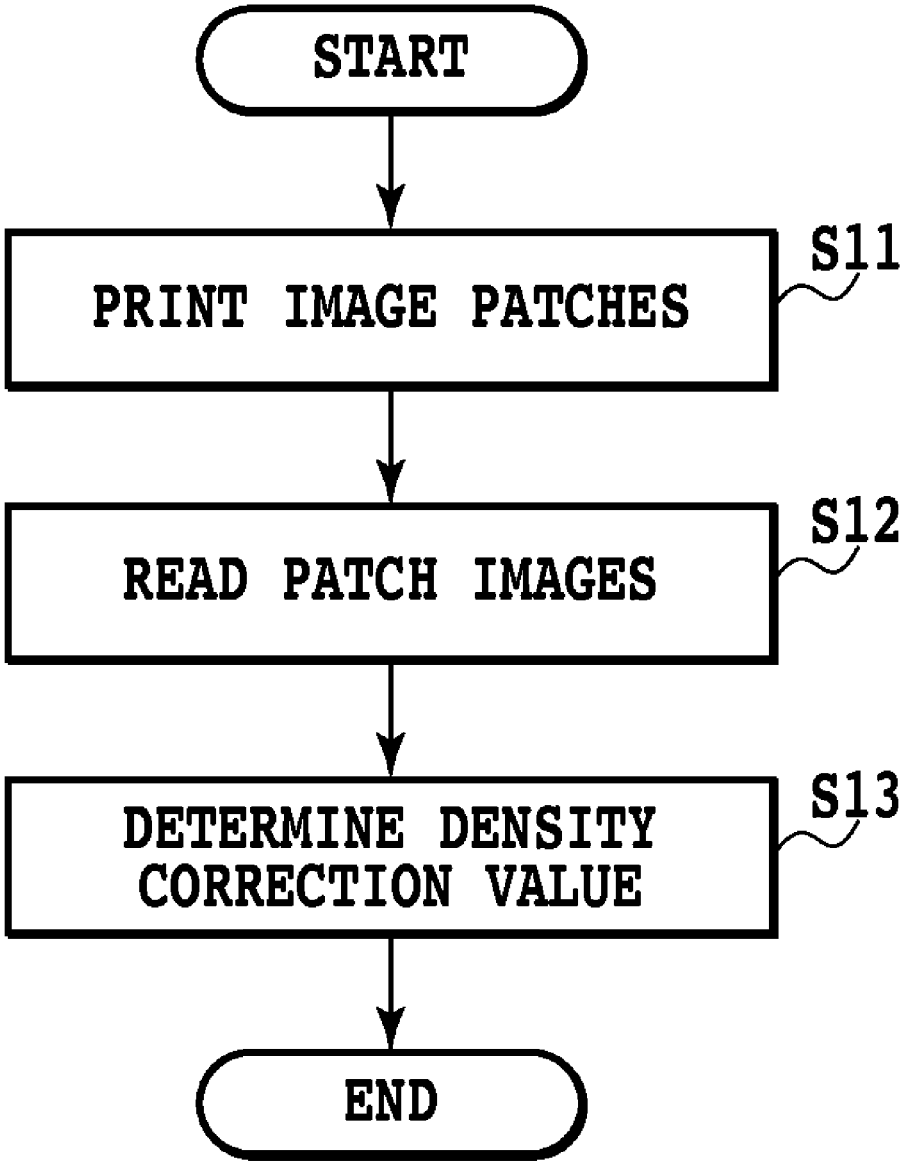
FIG. 16 is a flowchart for explaining the density correction value determination processing according to a third embodiment of the present invention.

FIG. 16 is a flowchart for explaining the process for calculating a density correction value.

First, image patches for a plurality of patterns are printed in the manner described above (step S11). Next, the scanning section 100 scans the printing results (step S12). The CPU 1000 compares, for each image patch, the density of the image portion at the joint PA with the density of the image portion at the other portions, and selects the pattern image patch for which the densities in the image portions are the nearest. Alternatively, a user may visually read the resulting printed image patches, and select the pattern with which joint line defect is least outstanding from the standpoint of density difference or texture difference. Next, the image input value used for printing the image patch corresponding to the selected pattern is employed to calculate a density correction value that is correlated to the deviation between the chips A and B (step S13). That is, the input value for an image at the joint PA is divided by the image input value for the other portions, and the resultant value, represented by a percentage, is a density correction value correlated with a deviation between the chips A and B.

Assume, for example, that when an image value of 142 is input for the joint PA and an image value of 128 is input for the portions other than the joint PA, the density of the image portion at the joint PA is nearest to the density of the image at the other portions. In this case, 111(%) (=142/128×100) is the density correction value.

As described above, in this embodiment, the image patches that have been printed are scanned to determine a density correction value corresponding to a chip deviation. When the density correction value is stored in the RAM 102, and a density correction method, as in the first embodiment, is employed, the density at the image portion printed by the joint can be corrected.

Other Embodiments

According to the present invention, when chip deviation information is obtained indicating misalignment equivalent to one pixel or greater, generally known methods for correcting a printing position may also be employed. For example, when a misalignment of +1.5 pixels is detected, dislocation of +1 pixel may be corrected by using the printing position correction method, and a +0.5 pixel dislocation may be corrected using the density correction method as described in the present invention.

The present invention can be broadly applied to various types of inkjet printing apparatuses that employ a line print head. With respect to line print head, any type can be used, so long as a plurality of nozzle arrays, each of which is formed of multiple nozzles for ejecting ink, are arranged in the direction in which the nozzles are arranged, and adjacent nozzle arrays overlap each other. Therefore, the line print head may be either a print head wherein adjacent nozzle arrays are mounted in different chips, or an assembly of multiple heads extended in the nozzle array direction, wherein adjacent nozzle arrays are mounted in different heads.

Furthermore, according to the present invention, correction of the print density of the overlapped nozzle array portion is based on the deviation between the adjacent nozzle arrays in the direction in which the nozzle arrays are extended. Therefore, when an inkjet printing system includes a host apparatus and an inkjet printing apparatus, as in FIG. 5, either the host apparatus may perform the density correction process (joint density correction process J1005), or the inkjet printing apparatus may perform this process. The correction of a print density, the printing of a test pattern, the detection of the printing results of a test pattern, and the determination of a correction value for a print density may be carried out by either the CPU of the inkjet printing apparatus, or the CPU of the host apparatus, or may be performed by the two in cooperation. Further, the inkjet printing apparatus can be employed not only as a constituent of an inkjet printing system by being connected to a host apparatus, such as a PC (Personal Computer), but also as a copier that includes a host apparatus.

In these embodiments, a gradation mask of 0% to 100% has been employed. However, a gradation mask of 30% to 70% can also be employed, so long as the total printing duty of the adjacent chips is fixed. Further, such a gradation mask providing a curved-gradient printing duty may also be employed.

The present invention can also be applied to a case wherein the printing duty at the overlapped portion is fixed at 50% for each adjacent chip, and the total printing duty is 100%. However, when the adjacent chips are misaligned with each other, the change in the density at the overlapped portion is different from that in the above embodiments. That is, when adjacent chips are misaligned in the direction leading from the chip A toward the chip B, an area where the printing duty is 50%, without being complemented, appears at the ends of the overlapped portion. And when the adjacent chips are misaligned in the direction leading from the chip B toward the chip A, an area where the printing duty becomes 150% appears at the ends of the overlapped portion. This area with a printing duty of 50% or 150% is extended when the chip deviation is increased. Therefore, the detected chip deviation is employed to calculate the size of the area where the printing duty does not reach 100%, and as well as in the above embodiments, a density correction value is calculated so that the printing duty in the area will be 100%. Also, the optimal density correction value corresponding to a deviation between the chips may be calculated in advance.

while the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-324155, filed Dec. 19, 2008, which is hereby incorporated by reference herein in its entirety.

What is claimed is:

1. A printing apparatus comprising:

a print head in which a first nozzle array and a second nozzle array, each formed of multiple nozzles for ejecting ink, are positioned by being shifted in a predetermined direction in which the nozzles are arranged so that nozzles of a portion positioned on one side of the first nozzle array and nozzles of a portion positioned on one side of the second nozzle array print on an area of a printing medium, use rate of the nozzles of the portion of the first nozzle array gradually decreases as the nozzles get close to one end of the first nozzle array, and use rate of the nozzles of the portion of the second nozzle array gradually decreases as the nozzles get close to one end of the second nozzle array;

a detection unit that detects a positional deviation between the first and second nozzle arrays in the predetermined direction; and a correction unit that corrects a print density of the area of the printing medium corresponding to both of the portions of the first and second nozzle arrays based on the positional deviation, the print density of the area being increased when the positional deviation increases due to the first and second nozzle arrays moving away from each other in the predetermined direction, and the print density of the area being decreased when the positional deviation increases due to the first and second nozzle arrays becoming closer to each other in the predetermined direction.

2. The printing apparatus according to claim 1, wherein the correction unit corrects a printing duty for the portions of the first and second nozzle arrays based on the positional deviation.

3. The printing apparatus according to claim 1, wherein the print head includes a plurality of chips, and the first and second nozzle arrays are mounted on different chips.

4. The printing apparatus according to claim 1, wherein the print head comprises a plurality of heads arranged in the predetermined direction in which the nozzles are arranged, and the first and second nozzle arrays are mounted in different heads.

5. The printing apparatus according to claim 1, wherein a test pattern is printed by the print head on the printing medium for comparing a print density of the area of the printing medium with a print density of the other area of the printing medium, and wherein the correction unit corrects the print density of the area based on a printing result of the test pattern.

6. A printing system comprising:

a print head in which a first nozzle array and a second nozzle array, each formed of multiple nozzles for ejecting ink, are positioned by being shifted in a predetermined direction in which the nozzles are arranged so that nozzles of a portion positioned on one side of the first nozzle array and nozzles of a portion positioned on one side of the second nozzle array print on an area of a printing medium, use rate of the nozzles of the portion of the first nozzle array gradually decreases as the nozzles get close to one end of the first nozzle array, and use rate of the nozzles of the portion of the second nozzle array gradually decreases as the nozzles get close to one end of the second nozzle array;

a detection unit that detects a positional deviation between the first and second nozzle arrays in the predetermined direction; and a correction unit that corrects a print density of the area of the printing medium corresponding to both of the portions of the first and second nozzle arrays based on the positional deviation, the print density of the area being increased when the positional deviation increases due to the first and second nozzle arrays moving away from each other in the predetermined direction, and the print density of the area being decreased when the positional deviation increases due to the first and second nozzle arrays becoming closer to each other in the predetermined direction.

7. A printing method comprising the steps of:

preparing a print head in which a first nozzle array and a second nozzle array, each formed of multiple nozzles for ejecting ink, are positioned by being shifted in a predetermined direction in which the nozzles are arranged so that nozzles of a portion positioned on one side of the first nozzle array and nozzles of a portion positioned on one side of the second nozzle array print on an area of a printing medium;

detecting a positional deviation between the first and second nozzle arrays in the predetermined direction;

printing on the printing medium including the area corresponding to both of the portions of the first and second nozzle arrays by using the first and second nozzle arrays, use rate of the nozzles of the portion of the first nozzle array gradually decreases as the nozzles get close to one end of the first nozzle array, and use rate of the nozzles of the portion of the second nozzle array gradually decreases as the nozzles get close to one end of the second nozzle array; and correcting a print density of the area of the printing medium corresponding to both of the portions of the first and second nozzle arrays based on the positional deviation, the print density of the area being increased when the positional deviation increases due to the first and second nozzle arrays moving away from each other in the predetermined direction, and the print density of the area being decreased when the positional deviation increases due to the first and second nozzle arrays becoming closer to each other in the predetermined direction.

* * * * *